United States Patent [19]

Weber et al.

[11] Patent Number: 4,534,292

[45] Date of Patent: Aug. 13, 1985

[54] SELF-DESTRUCT DEVICE FOR SPIN-STABILIZED PROJECTILE DETONATORS

[75] Inventors: Adolf Weber, Neunkirchen; Hans Strauss, Reichenschwand; Hans Pauly, Schwaig, all of Fed. Rep. of Germany

[73] Assignee: Diehl GmbH & Co., Nuremberg, Fed. Rep. of Germany

[21] Appl. No.: 562,851

[22] Filed: Dec. 19, 1983

[30] Foreign Application Priority Data

Dec. 24, 1982 [DE] Fed. Rep. of Germany ... 8236369[U]

[51] Int. Cl.[3] ..... F42C 1/04

[52] U.S. Cl. ..... 102/241; 102/245; 102/256

[58] Field of Search ..... 102/244–246, 102/237, 239, 241, 256, 272

[56] References Cited

U.S. PATENT DOCUMENTS

| | | | |
|---|---|---|---|
| 2,130,720 | 9/1938 | Junghans | 102/241 |
| 2,900,908 | 8/1959 | Burrell | 102/241 |
| 3,329,090 | 7/1967 | Rhoads | 102/241 |
| 3,613,594 | 10/1971 | Burke | 102/241 |
| 3,724,384 | 4/1973 | Donahue | 102/246 X |
| 4,262,598 | 4/1981 | Burg et al. | 102/246 |

FOREIGN PATENT DOCUMENTS

| | | | |
|---|---|---|---|
| 2405179 | 8/1975 | Fed. Rep. of Germany | 102/241 |
| 2364289 | 5/1978 | Fed. Rep. of Germany | 102/241 |

*Primary Examiner*—David H. Brown

*Attorney, Agent, or Firm*—Scully, Scott, Murphy and Presser

[57] ABSTRACT

A self-destruct device for the detonators of spin-stabilized projectiles, wherein a generally crescent-shaped locking lever is pivotably supported on a circular disc-shaped plate which extends perpendicular to the longitudinal projectile axis. In its extended position, the locking lever engages below a spring-loaded percussion sleeve arranged so as to be axially displaceable on the firing pin which, in turn, is latched by means of the hook on a tripping lever which can be swung outwardly against the force of a spring engaging therewith during firing as a result of the centrifugal force exerted thereon caused by the projectile spin. The arm of the tripping lever which sustains the centrifugal force is subordinated in its extended position to a safety support which is fastened on the plate and, subsequent to the outward pivoting of the tripping lever, and also through the centrifugal force, is radially displaceable and thereby releases the tripping lever. As a result, upon a dropoff in the rotational speed of the projectile, the tripping lever unlatches the percussion sleeve through the locking lever, whereupon the percussion sleeve impacts against a shoulder or the like on the firing pin, and permits the latter to force itself into the detonator capsule of the detonator.

4 Claims, 3 Drawing Figures

SELF-DESTRUCT DEVICE FOR SPIN-STABILIZED PROJECTILE DETONATORS

BACKGROUND OF THE INVENTION

1. Field of the Invention

The present invention relates to a self-destruct device for the detonators of spin-stabilized projectiles, wherein a generally cresent-shaped locking lever is pivotably supported on a circular disc-shaped plate which extends perpendicular to the longitudinal projectile axis. In its extended position, the locking lever engages below a spring-loaded percussion sleeve arranged so as to be axially displaceable on the firing pin which, in turn, is latched by means of the hook on a tripping lever which can be swung outwardly against the force of a spring engaging therewith during firing as a result of the centrifugal force exerted thereon caused by the projectile spin. The arm of the tripping lever which sustains the centrifugal force is subordinated in its extended position to a safety support which is fastened on the plate and, subsequent to the outward pivoting of the tripping lever, and also through the centrifugal force, is radially displaceable and thereby releases the tripping lever. As a result, upon a dropoff in the rotational speed of the projectile, the tripping lever unlatches the percussion sleeve through the locking lever, whereupon the percussion sleeve impacts against a shoulder or the like on the firing pin, and permits the latter to force itself into the detonator capsule of the detonator.

2. Discussion of the Prior Art

In a self-destruct device of the above-described type which has become known from German Petty Patent 75 20 035, sideways-directed impacts during the infeed of the ammunition can eliminate the close fit between the arm sustaining the centrifugal force weight and the safety support. Consequently, the self-destruct device is rendered live permanently.

SUMMARY OF THE INVENTION

Accordingly, it is an object of the present invention to so construct the self-destruct device in a simple and inexpensive manner, as to render the device insensitive to sideways-directed impacts and to thereby allow it to remain secured. Pursuant to the invention, in order to achieve the foregoing object, a spring is fastened to the locking lever, and the prestressed spring contacts against the hook.

In accordance with advantageous features of the inventive device, there is contemplated a compact configuration for the spring, and in which the required force of the spring can be obtained in a simple manner. The inventive structure affords that the self-destruct device, upon being subjected to sideways-directed impacts such as can occur during the infeed of the ammunition, will remain in a "secured" position. Currently employed self-destruct devices can be retrofitted in a simple manner in that the locking lever is equipped with the spring. Consequently, there can be eliminated any fundamental modifications in the presently employed principles of construction. The collective manufacturing procedures remain unchanged. The relatively low force of the spring, which is a leaf spring, exerts no influence over the regular function during the sequence of the self-destruct activation. Besides the force exerted by the spring, for the function of the safety device in the "secured" position, it is also essential that the gap between the support hook and the locking lever is almost completely filled through suitable dimensioning of the thickness of the spring. Thereby, in a simple manner, there are already dampened the movements of the locking lever and the tripping lever due to the thickness of the spring, in addition to the force of the spring.

BRIEF DESCRIPTION OF THE DRAWINGS

Reference may now be had to the following detailed description of an exemplary embodiment of the self-destruct device pursuant to the invention, taken in conjunction with the accompanying drawings; in which.

DETAILED DESCRIPTION

Figure 1:
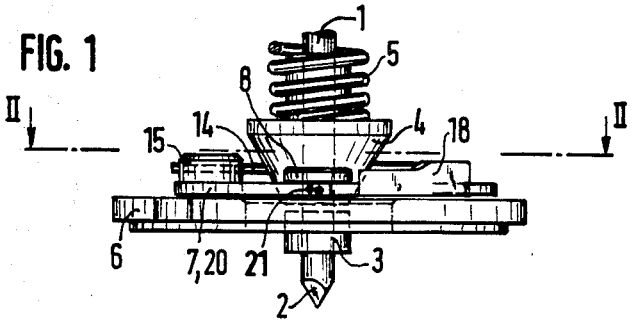
FIG. 1 illustrates a partial side view of the self-destruct device for the detonator of a spin-stabilized projectile.

Illustrated in FIG. 1 is merely a firing pin 1 of a percussion detonator which is known per se, supported so as to be axially displaceable within the detonator in a known manner, and which upon striking against a target has a point 2 adapted to be forced into a detonator capsule (not shown).

However, during impact against the target, it should also be possible to force the firing pin 1 in by means of a self-destruct device of known type. Serving this purpose, is a shoulder 3 on the firing pin 1, as well as a percussion sleeve 4 which is axially displaceably supported on the firing pin 1, and which is subjected to the pressure of a spring 5. Employed in the control of this percussion sleeve 4 is a destructor plate, shown in a top plan view in FIG. 2, and which consists of an annular disc-shaped plate 6, supported on which is a generally crescent-shaped locking lever 7. This locking lever 7 fixedly retains the percussion sleeve 4 in its initial position with the spring 5 stressed. Positioned directly opposite a trunnion 8 serving as a bearing, the locking lever 7 incorporates a hook 9 which is engaged by a coacting hook 10 on a tripping lever 11 pivotably supported on the plate 6 through a bolt 17. On a second arm 12, the tripping lever 11 is provided with a fly weight 13 which, additionally, serves as a stop for a spring 14 the other end of which is anchored in a column 15 on the plate 6.

The arm 12 is secured in its equilibrium position by a safety support 18. For this purpose the arm 12 includes gripping claw 19 which prevents any radial outward throw of the free end of the safety support 18 prior to firing, for example, in response to transport impacts or shocks.

Figure 2:
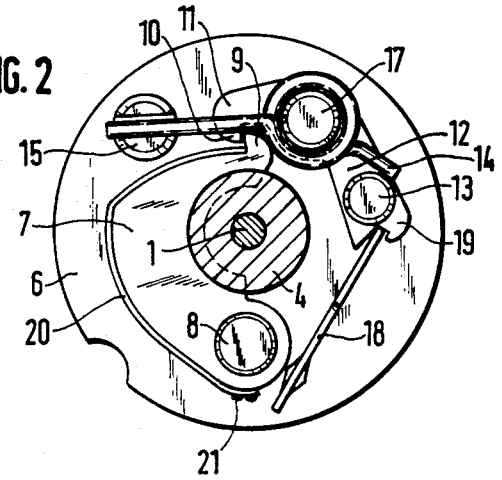
FIG. 2 is a plan view of a destruct plate for the spin-dependent control for the self-destruction in the inventive configuration.
Figure 3:
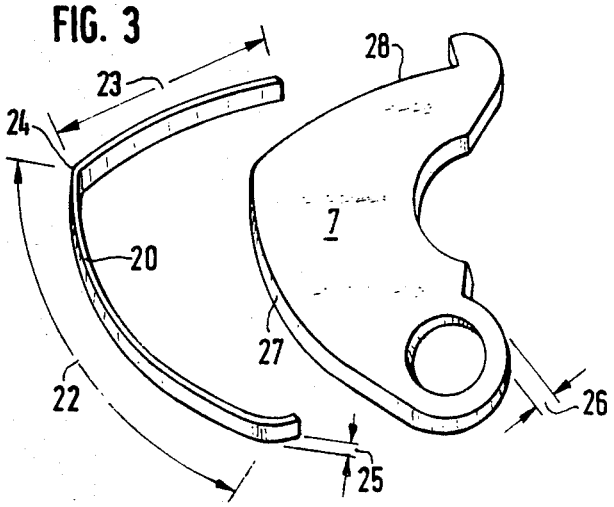
FIG. 3 is a perspective exploded view of details in FIG. 2.

Welded to the locking lever 7 at point 21 is a leaf spring 20. The leaf spring 20 includes two curved sections 22 and 23, as well as a bent edge 24. The height 25 of the leaf spring 20 corresponds to the height 26 of the locking lever 7. The stressed leaf spring 20 as shown in FIG. 2 has its curved sections 22 and 23 lie against corresponding portions 27, 28 on the locking lever 7.

When encountering sideways-directed impacts, responsive to which because of the fly weight 13, the arm 12 would tend to lift away from the safety support 18, the spring 20 prevents any pivotal motion of that kind by the tripping lever. The force of the spring 14 is amplified by the spring 20.

The self-destruct device of the above-described type operates essentially in the same manner as currently known devices.

When the projectile equipped with a detonator of the described type is fired under spin from a weapon, then through the effect of the centrifugal force, the fly weight 13 is displaced radially outwardly against the force of the springs 14 and 20; in essence, the tripping lever 11 is pivoted in a counterclockwise direction. The gripping claw 19 releases the end of the safety support 18, and the latter pivots outwardly away under centrifugal force.

When the projectile does not strike against a target during its flight, then the rotational speed of the projectile drops off gradually. If it falls below the limit at which the return pivoting force of the springs 14 and 20 is larger than the outward deflecting force of the flyweight 13, then the springs 14 and 20 will swing the tripping lever in a clockwise direction. Since the safety support 18 has been pivoted out of the way, the swinging angle of the tripping lever is thus not restricted. The hook engagement 9, 10 is freed, and the locking lever 7 can pivot out of the way. However, thereby it releases the percussion sleeve 4 (FIG. 1). This strikes under the force of spring 5 against the shoulder 3 on the firing pin 1, and pushes the point 2 thereof into the detonating capsule of the detonator.

What is claimed is:

1. In a self-destruct device for a detonator of a spin-stabilized projectile, including an annular disc-shaped plate positioned perpendicular to the longitudinal projectile axis; a spring-loaded percussion sleeve axially slideably mounted on a firing pin of said detonator; a locking lever pivotably supported on said plate and having an initial position engaging the percussion sleeve; a tripping lever pivotably supported on said plate, having first and second arms, and having an initial position where the first arm engages the locking lever to hold the locking lever in its initial position; a flyweight supported on the second arm of the tripping lever; a primary spring urging the second arm of the tripping lever radially inward; and a safety support fastened on the plate and having an initial position engaging the second arm of the tripping lever to limit radially inward movement of said second arm and hold the tripping lever in its initial position; wherein upon rotation of said plate resulting from a firing of the projectile, centrifugal forces cause the flyweight and the second arm of the tripping lever to pivot radially outward against the force of the primary spring and away from the safety support, and the safety support moves radially outward; and then upon a decrease in the rotational speed of the disc, the primary spring forces the second arm of the tripping lever radially inward and the first arm thereof radially outward, away from the locking lever, the locking lever moves away from its initial position, and the percussion sleeve strikes the firing pin; the improvement comprising:

an auxiliary spring supported on the disc and having a free end located adjacent and radially inward of the first arm of the tripping lever, the free end of the auxilary spring moving radially outward and engaging the first arm of the tripping lever to inhibit the second arm of the tripping lever from moving away from the safety support upon impacts on the side of the disc that tend to cause the flyweight to move radially outward.

2. Device as claimed in claim 1, wherein the tripping and locking levers are in their initial positions, (i) the first arm of the tripping and the locking lever form a radially extending space, and (ii) the free end of the auxiliary spring extends into the radially extending space, but does not completely fill said space to allow radially inward movement of the first arm of the tripping lever.

3. Device as claimed in claim 1, wherein the auxiliary spring comprises a leaf spring having two curved sections, and has an initial position in which the auxiliary spring lies against, and generally conforms to the shape of, an outside surface of the locking lever.

4. Device as claimed in claim 3, wherein the curved sections of the leaf spring are of generally the same size.

* * * * *